US008172584B2

(12) United States Patent
Yamamoto et al.

(10) Patent No.: US 8,172,584 B2
(45) Date of Patent: May 8, 2012

(54) ELECTRICAL CONNECTION MECHANISM FOR CONNECTING AN ELECTRICAL PART TO A JUNCTION BOX

(75) Inventors: Takeyoshi Yamamoto, Saitama (JP); Yasuhiro Nakada, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 13/041,862

(22) Filed: Mar. 7, 2011

(65) Prior Publication Data

US 2011/0230099 A1 Sep. 22, 2011

(30) Foreign Application Priority Data

Mar. 18, 2010 (JP) ..... 2010-062423

(51) Int. Cl.
*H01R 12/00* (2006.01)

(52) U.S. Cl. ..... 439/76.2

(58) Field of Classification Search ..... 439/76.2, 439/626; 310/71, 90; 361/752
See application file for complete search history.

(56) References Cited

U.S. PATENT DOCUMENTS

| | | | | |
|---|---|---|---|---|
| 5,546,626 | A * | 8/1996 | Chung | 15/167.1 |
| 6,796,808 | B2 * | 9/2004 | Hosoe et al. | 439/76.2 |
| 7,006,355 | B2 * | 2/2006 | Wakabayashi et al. | 361/728 |
| 7,267,556 | B2 * | 9/2007 | Oka | 439/76.2 |
| 7,391,139 | B2 * | 6/2008 | Yamamoto | 310/90 |
| 7,531,928 | B2 * | 5/2009 | Yamamoto | 310/90 |
| 7,614,886 | B2 * | 11/2009 | Choi | 439/76.2 |
| 7,717,580 | B2 * | 5/2010 | Takata et al. | 362/97.1 |
| 7,896,513 | B2 * | 3/2011 | Takata et al. | 362/97.1 |
| 2005/0206255 | A1 * | 9/2005 | Yoshino et al. | 310/71 |
| 2006/0158052 | A1 * | 7/2006 | Yamamoto | 310/90 |
| 2008/0272866 | A1 * | 11/2008 | Ohkubo et al. | 335/17 |

FOREIGN PATENT DOCUMENTS

| | | | |
|---|---|---|---|
| JP | 11-329641 | A | 11/1999 |
| JP | 2001-327037 | A | 11/2001 |
| JP | 3589154 | B2 | 11/2004 |
| JP | 3750347 | B2 | 3/2006 |

* cited by examiner

*Primary Examiner* — Chandrika Prasad
(74) *Attorney, Agent, or Firm* — Arent Fox LLP

(57) ABSTRACT

Provided is a connection mechanism which connects a switch portion 20 of a generator 1 to an assembling terminal 11 of a junction box 10 having plural female terminals 12 connected to a generator circuit 13 via a relay connector 30, wherein the relay connector 30 forms a defining wall 31 inside a cylindrical body so that a fitting portion 32 is provided at one side of the defining wall 31 so as to be fitted to the switch portion 20, and plural relay terminals are attached to the other side so as to be connected to the plural female terminals 12, and wherein holes 35 are provided in the defining wall so as to respectively face the front ends of the relay terminals 33. Accordingly, the switch portion 20 and the assembling terminal 11 are integrally and directly connected to each other via the relay connector 30.

5 Claims, 5 Drawing Sheets

PRIOR ART

ELECTRICAL CONNECTION MECHANISM FOR CONNECTING AN ELECTRICAL PART TO A JUNCTION BOX

TECHNICAL FIELD

The present invention relates to a connection mechanism which connects an electric part such as a switch portion mounted on an operation panel of an operating machine such as a generator driven by an engine to a junction box having a generator circuit with plural terminals, and particularly, to an electric part connection mechanism in an operating machine having a relay connector integrally connecting an electric part (switch portion) to a junction box.

BACKGROUND ART

As an electric part mounted on an operation panel of a generator driven by an engine, for example, there has been known a voltage switching switch 70 for high current as shown in FIG. 8. The voltage switching switch 70 for high current is fixed to the rear surface of an operation panel 80 so that a movable switch 71 faces outward from a square window 81 provided in the operation panel 80, and includes plural (twelve) male terminals 72 which are provided on the rear surface thereof. The twelve male terminals are respectively connected to a generator circuit (not shown) via two seatbelt connectors 90, 90 each having six female terminals.

Further, Japanese Patent publication Nos. 3750347 and 3589154 disclose a structure in which plural terminals formed inside a junction box are connected to an assembling connector.

CITATION LIST

Patent Literature

Patent Literature 1 Japanese Patent Publication No. 3750347
Patent Literature 2 Japanese Patent Publication No. 3589154

SUMMARY OF INVENTION

Technical Problem

In the structure in which the seatbelt connectors 90 shown in FIG. 8 are connected to the voltage switching switch portion 70 for high current, the voltage switching switch portion 70 for high current is not provided with an insertion guide but provided with the plural male terminals 72 that are exposed to the outside. Therefore, a problem arises in that the terminals may bend during the fitting operation and the assembling workability is not good due to an insertion/extraction load or the like.

On the other hand, water may intrude into the rear side of the movable switch 71 through a gap between the movable switch 71 and the square window 81 of the operation panel 80 due to an environment in use of the generator. The water also intrudes, through the movable portion of the movable switch 71, into the switch portion 70, flows through a water draining hole 73, and then is guided toward the generator circuit along a cable 74 disposed at the rear side of the switch, thereby causing a problem in use of the generator.

Further, in the structures disclosed in Japanese Patent Publication Nos. 3750347 and 3589154, the plural terminals formed inside the junction box are connected to the assembling connector, but a structure of a relay connector connecting terminal groups to each other is not disclosed.

Furthermore, in Japanese Patent Publication Nos. 3750347 and 3589154, a structure of preventing the intrusion of the water into the connection portion of the terminal groups is not disclosed.

The invention is made in view of such circumstances, and provides an electric part connection mechanism which is disposed in an operating machine, connects an electric part such as a switch portion attached to an operation panel of an operating machine driven by an engine to a junction box having plural terminals connected to a circuit of an operating machine via a relay connector, and is capable of allowing easy assembling and improving waterproofness by studying a structure of the relay connector.

Solution to Problem

To achieve the above object, an electric part connection mechanism of the present invention (claim 1) is disposed in an operating machine and connects an electric part (20) mounted on an operation panel (5) of an operating machine (1) to an assembling terminal of a junction box (10) having a plurality of terminals connected to a circuit of the operating machine (13) via a relay connector (30) of a cylindrical body, wherein the relay connector (30) includes:

- a defining wall (31) which is formed inside the cylindrical body;
- a fitting portion (32) which is formed at one side of the defining wall so as to fit the electric part (20);
- a plurality of relay terminals (33) which is attached to the other side of the defining wall (31) and is connectable to the plurality of terminals; and
- a plurality of holes which is provided in the defining wall (31) so as face the front ends of the plurality of relay terminals, respectively.

The present invention of the claim 2 is the electric part connection mechanism according to claim 1, comprising:

a waterproof sheet (40) which is attached to the fitting portion (32) side of the defining wall (31), and has a plurality of holes (41) corresponding to the plurality of holes (38); and an opening or a notch which is provided at the lower portion, in the direction of gravity, of an outer wall of the cylindrical body so as to allow the fitting portion (32) to communicate with the outside thereof.

The present invention of the claim 3 is the electric part connection mechanism according to claim 2, wherein the opening or the notch (38) provided in the outer wall of the relay connector (30) is disposed closer to the operation panel (5) than the waterproof sheet (40).

The present invention of the claim 4 is the electric part connection mechanism according to claim 2, wherein the waterproof sheet (40) includes holes (43) which allow protrusions (37), provided at asymmetric positions in the defining wall (31), to be inserted thereinto (40).

The present invention of the claim 5 is the electric part connection mechanism according to claim 3, wherein the waterproof sheet (40) includes holes (43) which allow protrusions (37), provided at asymmetric positions in the defining wall (31), to be inserted thereinto.

Advantageous Effects of Invention

According to the configuration of the first feature (claim 1), since the hole (35) is provided in the defining wall (31) of the relay connector (30), each relay terminal (33) may be electrically connected to the electric part (20) fitted to the fitting portion (32). Since the relay terminals are connectable to the plural terminals (female terminals, the terminals (female terminals) of the assembling terminal may be integrally and directly connected to the electric part via the relay connector, so that the number of steps of connecting/assembling operations may be decreased.

According to the configuration of the second feature (claim 2), since the waterproof sheet (40) is attached to the defining wall (31), water may be prevented from intruding into the relay connector (30) to which the relay terminals (33) are attached, and the water may be made flow to the outside of the relay connector (30) from the notch (38) or the opening.

According to the configuration of the third feature (claim 3), since the notch (38) or the opening is disposed closer to the operation panel (5) than the waterproof sheet (40), the water intruding into the fitting portion (32) may be made reliably flow to outside of the relay connector (30).

According to the configuration of the fourth feature (claim 4 and claim 5), since the holes (43) of the waterproof sheet (40) are fitted to the protrusions (37) provided at asymmetric positions of the defining wall (31), the waterproof sheet (40) may be easily placed at a correct position at which the holes (41) of the waterproof sheet (40) are disposed corresponding to the holes of the defining wall.

DESCRIPTION OF EMBODIMENTS

Hereinafter, an exemplary embodiment of an electric part connection mechanism of an operating machine of the invention will be described with reference to FIGS. 1 to 7A and FIG. 7B.

Figure 1:
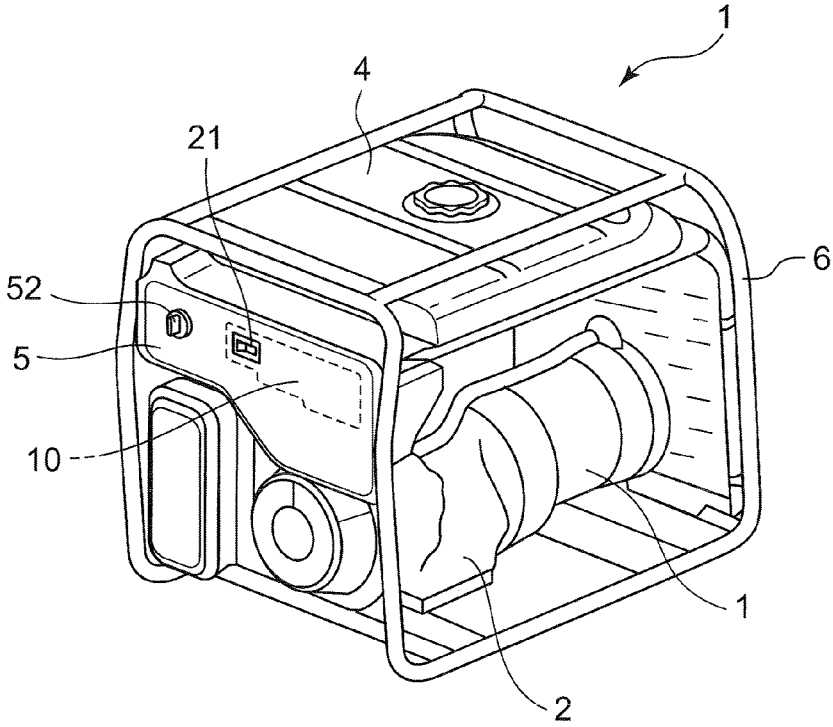
FIG. 1 is a perspective view illustrating the appearance of a generator adopting an electric part connection mechanism according to an embodiment of the invention.

The electric part connection mechanism of the operating machine of the invention is applied to an engine generator (operating machine) 1 as shown in FIG. 1. The engine generator 1 has a structure in which, on a frame 6, an engine 2 which is driven by gasoline, an AC generator 3 which is driven by the engine 2 so as to generate electricity, a fuel tank 4 which contains gasoline therein, and a control panel (operation panel) 5 which is used to perform various operations, and the like are mounted.

The control panel 5 is equipped with a start switch 51 which is used to start a driving operation of the engine, a voltage switching switch 21 which is used to switch an output voltage (100 V and 200 V), various display units (not shown) which are used to display an operation status thereon, and the like.

Figure 2:
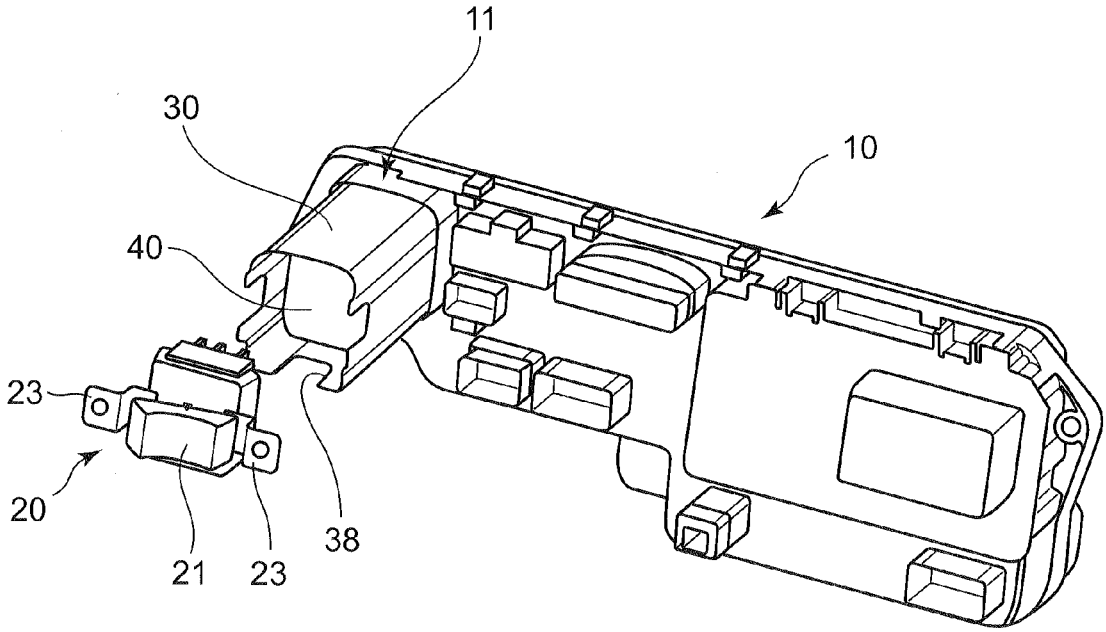
FIG. 2 is a perspective view illustrating the electric part connection mechanism according to the embodiment of the invention.
Figure 3:
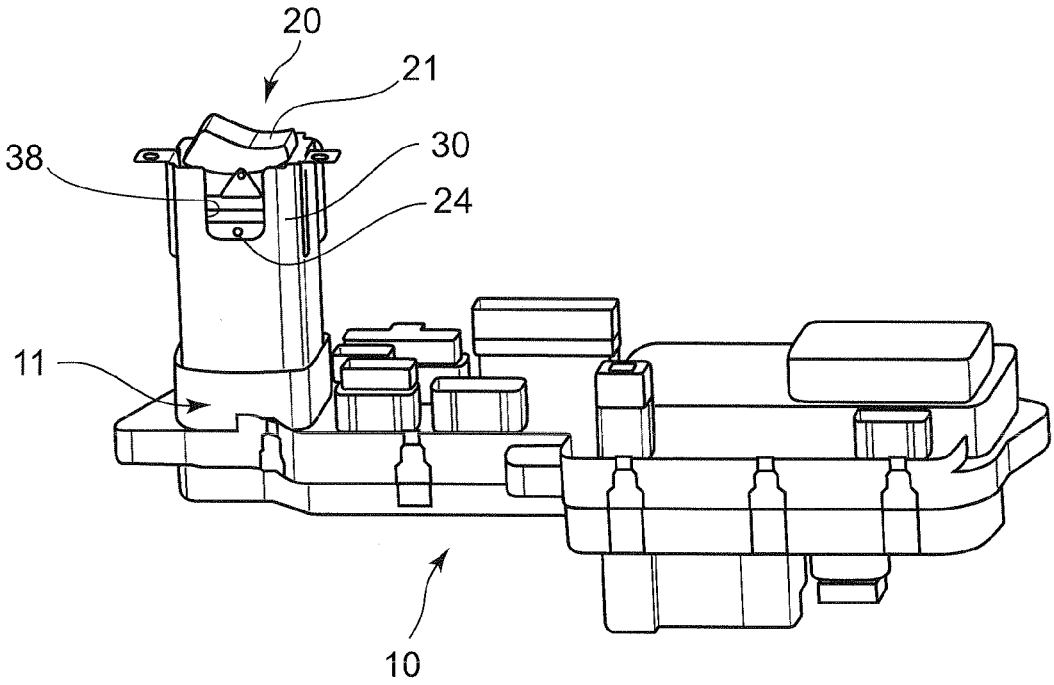
FIG. 3 is a perspective view illustrating the electric part connection mechanism according to the embodiment of the invention when it is seen from the lower side thereof (the lower side in the direction of gravity)
Figure 4:
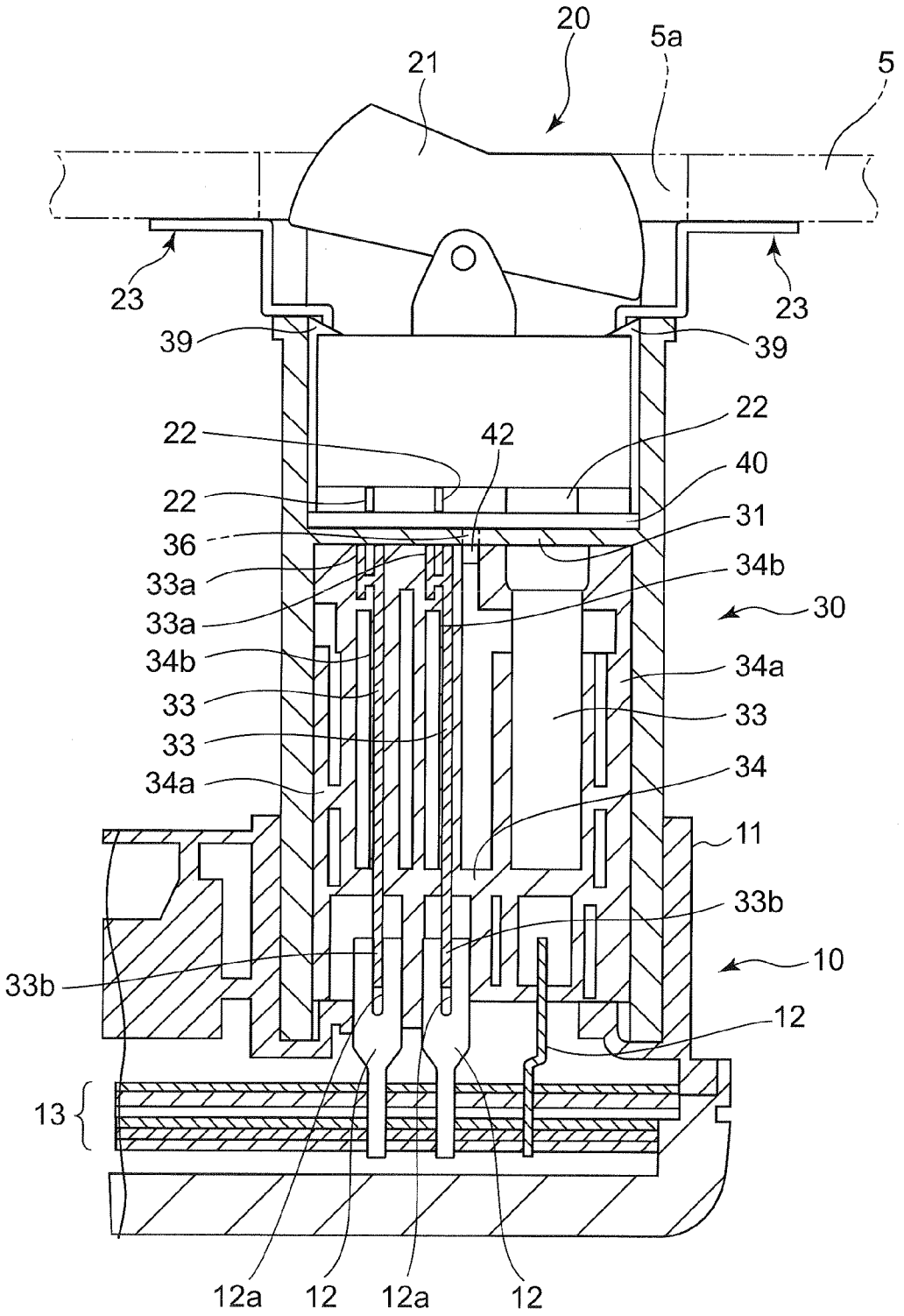
FIG. 4 is a perspective view illustrating a cross-section of a fitting portion of the electric part connection mechanism according to the embodiment of the invention.

As shown in FIGS. 2 and 3, a junction box 10 constituting a control panel casing is disposed at the rear side of the control panel 5. An assembling terminal 11 is formed at the left position of the junction box 10 so as to be connected to an electric circuit of the junction box 10. As shown in FIG. 4, plural female terminals 12 are disposed inside the square wall body inside the assembling terminal 11, and a socket 12*a* is formed at the center of each female terminal 12. The opposite side of the socket formation side of each female terminal 12*a* is connected to a generator circuit 13 which is formed by laminating plural panel substrates attached to the junction box 10.

The assembling terminal 11 of the junction box 10 and the switch portion 20, as electric parts, mounted on the control panel 5 are connected to each other via a cylindrical relay connector 30, thereby forming a connection mechanism.

The switch portion 20 is used to switch the connection of the generator circuit (a circuit of an operating machine) 13 of the junction box 10 so that the voltage supplied from the engine generator 1 is switched when the voltage switching switch 21 disposed on the front surface of the control panel 5 is switched. Further, plural male terminals 22 are disposed on the rear surface of the switch portion 20 in a protruding manner, where the male terminals 22 are connected to the internal circuit so that the connection status thereof is changed when the voltage switching switch 21 is switched.

Stays 23 and 23 are attached to the voltage switching switch 21 of the switch portion 20 so as to be connected to the rear surface of the control panel 5.

Further, a water draining hole 24 is provided in the switch portion 20 so as to drain water intruding into the switch portion 20 from a movable portion of the voltage switching switch 21 as in a switch portion 70 described in the related art (refer to FIG. 3).

As described above, the female terminals 12 formed as plural pins connected to the generator circuit (a circuit of an operating machine) 13 are uprightly disposed in the assembling terminal 11 of the junction box 10 (refer to FIG. 4).

Figure 5:
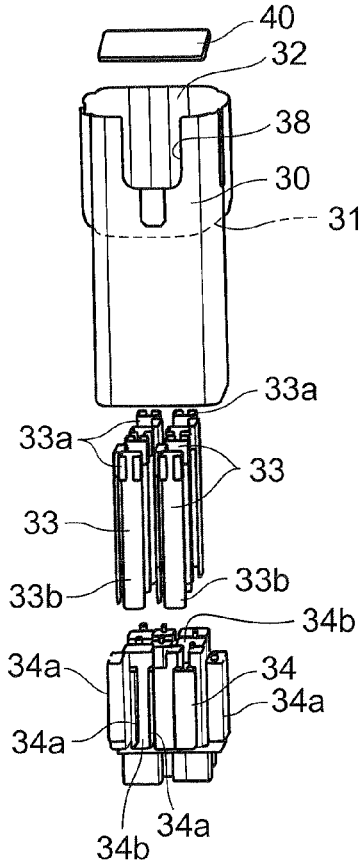
FIG. 5 is a perspective view illustrating a relay connector used in the electric part connection mechanism according to the embodiment of the invention.

In the relay connector 30, a defining wall 31 is integrally formed with the inside of the cylindrical body, and a fitting portion 32 fitted to the switch portion 20 mounted on the control panel 5 is provided on one side of the relay connector (refer to FIG. 5). Further, plural relay terminals 33 and a guide body 34 supporting the relay terminals are inserted and disposed on the other side of the relay connector 30, and one ends of the relay connectors 33 are fitted to the assembling terminals 11 (refer to FIGS. 4 and 5).

As shown in FIG. 5, in the relay terminal 33, a female terminal 33*a* serving as a socket formed by bending an elongated conductive member piece is disposed near the defining wall 31 in the longitudinal direction, and a male terminal 33*b* formed in a planar shape is disposed near the junction box.

The guide body 34 is formed of an insulating resin, and is formed so that the elongated relay terminal 33 is disposed at the connection position with respect to each female terminal 12 of the assembling terminal 11. The guide body 34 has a shape in which plural contact pieces 34*a* are formed in the periphery thereof so as to come into contact with the inner wall of the relay connector 30, and plural penetration holes 34*b* (corresponding to the number of relay terminals 33) are formed so that the relay terminals 33 are inserted and extracted in the longitudinal direction (refer to FIG. 4).

The male terminal 22 of the switch portion 20 is fitted to the female terminal 33*a* of the relay terminal 33 disposed near the defining wall 31, and the female terminal 12 of the assembling terminal 11 is fitted to the male terminal 33*b* of the relay terminal 33 disposed near the assembling terminal 11. Since the relay terminal 33 is disposed inside the penetration hole 34*b* of the guide body 34, the positions of the female terminal 33*a* and the male terminal 33*b* are regulated at the uniform positions. Accordingly, since the deviation between the terminals is prevented when the relay connector 30 is fitted to the switch portion 20 and the relay connection 30 is fitted to the assembling terminal 11, the insertion of the terminals may be reliably performed.

Figure 6:
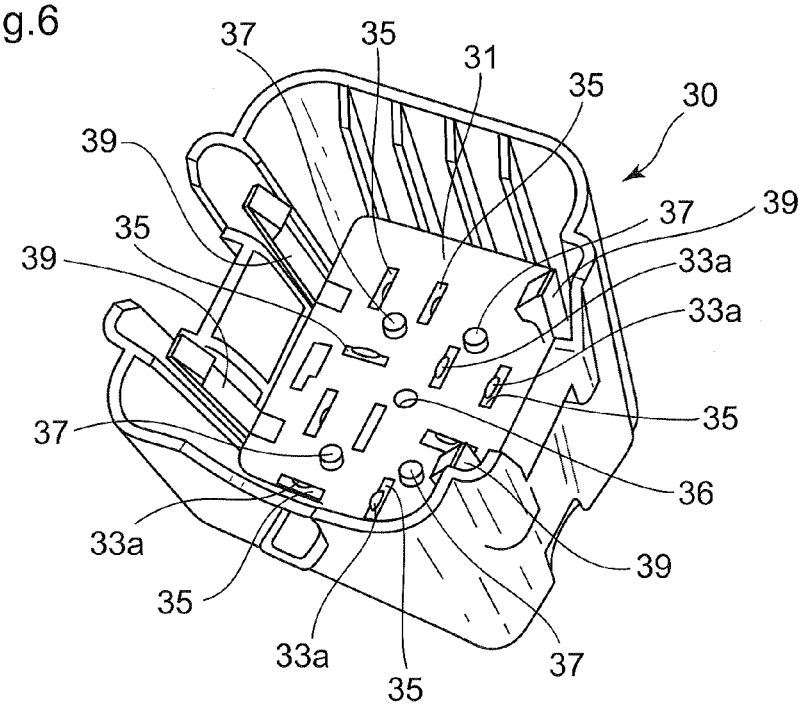
FIG. 6 is a perspective view illustrating the relay connector used in the electric part connection mechanism according to the embodiment of the invention.

As shown in FIG. 6, the defining wall 31 of the relay connector 30 is provided with a hole 35 facing the female terminal 33*a* of each relay terminal 33. Further, a central hole 36 is formed at the center position of the defining wall 31. Plural column-like protrusions 37 are formed at appropriate positions of the defining wall 31 at which the holes 35 are not provided so as to protrude toward the fitting portion 32. The plural protrusions 37 are provided at asymmetric positions on the defining wall 31. Further, the central hole 36 formed in the defining wall 31 may be formed as a concave portion on the fitting portion 32 side of the defining wall 31 instead of the hole.

Further, two pairs of support members 39 are attached to the fitting portion 32 of the relay connector 30 so as to reliably fix the switch portion 20 into the fitting portion 32. The front end of each support member 39 is provided with a hook supporting the upper surface of the switch portion 20.

Figure 7A:
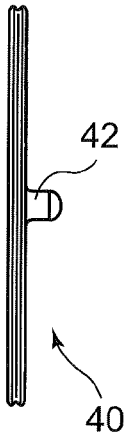
FIG. 7A is a side view illustrating a waterproof sheet adhered to the inside of the relay connector.
Figure 7B:
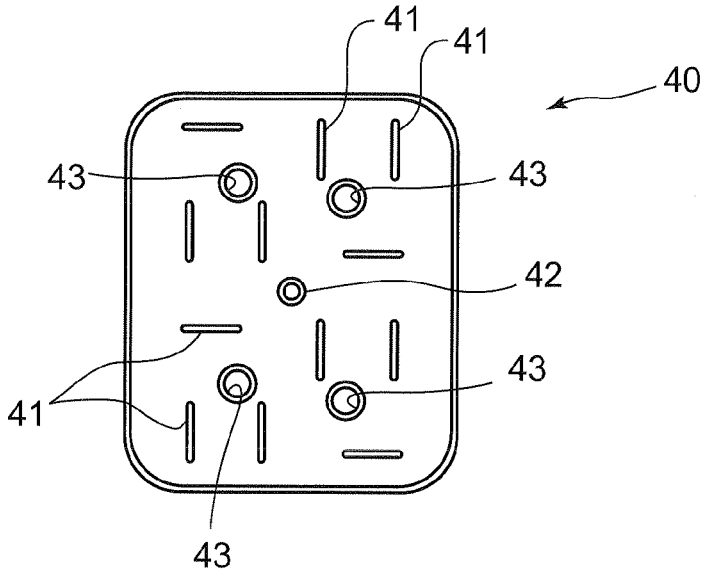
FIG. 7B is a rear view illustrating the waterproof sheet.
Figure 8:
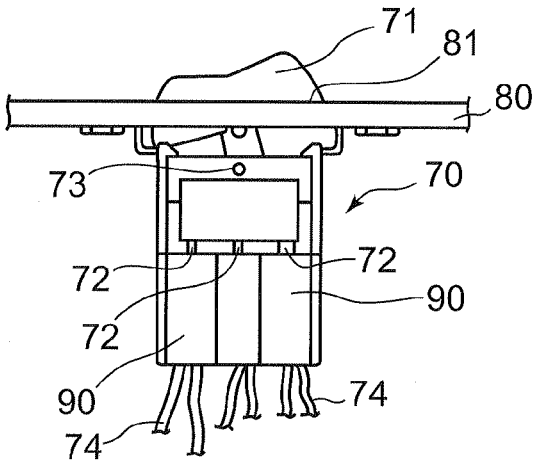
FIG. 8 is an explanatory diagram illustrating a structure of an existing switch connection mechanism.

As shown in FIGS. 7A and 7B, a waterproof sheet 40 is placed on the fitting portion 32 side of the defining wall 31. Plural holes 41 are perforated in the waterproof sheet 40 so as to correspond to the holes 35 of the defining wall 31, a convex portion 42 is formed at the center of the lower surface side of the waterproof sheet so as to correspond to the fitting portion 36 of the defining wall 31, and circular holes 43 are formed in the waterproof sheet so as to correspond to the protrusions 37 of the defining wall 31.

When the waterproof sheet 40 is placed on the fitting portion 32 side of the defining wall 31, the convex portion 42 of the waterproof sheet 40 is fitted to the central hole 36 of the defining wall 31, and each protrusion 37 of the defining wall 31 is inserted into the circular hole 42 of the waterproof sheet 40, so that the holes 35 of the defining wall 31 are aligned in position with the holes 41 of the waterproof sheet 40.

In the outer peripheral wall of the relay connector 30, a notch 38 allowing the fitting portion 32 to communicate with the outside thereof is provided at a lower position in the direction of gravity when the engine generator 1 takes a normal posture. The notch 38 is located at a position closer to the control panel 5 than the waterproof sheet 40 disposed inside the relay connector 30, and the water draining portion 22 formed in the switch portion 20 is located inside the notch 38.

Accordingly, water intruding from the water draining hole 24 into the relay connector 30 via a gap of the switch movable portion of the switch portion 20 is prevented from flowing toward the relay terminal 33 due to the presence of the waterproof sheet 40, and may be discharged from the notch 38 to the outside of the relay connector 30.

In the above-described example, the water draining portion of the relay connector 30 is formed as the notch 38 formed by cutting a part of the outer wall, but may be formed as an opening formed by perforating a part of the outer wall.

According to the above-described example, a connection mechanism for the switch portion 20 mounted on the control panel 5 is exemplified, but the invention is not limited to the switch portion 20. For example, the invention may be applied to other electric parts mounted on the control panel 5. Further, the invention is not limited to the generator, but may be applied to an operating machine having a control panel (operation panel) 5 such as a pump.

According to the switch connection mechanism of the above-described generator, since plural male terminals 22 of the switch portion 20 are integrally and directly connected to plural female terminals 12 of the assembling terminal 11 of the junction box 10 via the relay terminals 33 of the relay connector 12, connecting/assembling operations may decrease in number of assembling steps.

Further, since the guide body 34 is disposed inside the relay connector 30 so as to maintain the fixed positions of the female terminals 33*a* and the male terminals 33*b* of the relay terminal 33, the deviation between the terminals may be prevented when each male terminal 22 of the switch portion 20 is fitted and each female terminal 12 of the assembling terminal 11 is fitted, and hence the insertion of the terminals may be reliably performed.

Furthermore, since the defining wall 31 is provided inside the relay connector 30 and the waterproof sheet 40 is placed on the defining wall 31, water may be blocked by the waterproof sheet 40 and discharged from the notch 38 even when the water intrudes, from a gap of the switch movable portion or the like, into the switch portion 20. Accordingly, the water may be prevented from intruding into the relay terminals 33 of the relay connector 30, which is helpful in preventing troubles from occurring in the generator circuit 13.

REFERENCE SIGNS LIST

1: ENGINE GENERATOR (OPERATING MACHINE)
2: ENGINE
3: AC GENERATOR
4: FUEL TANK
5: CONTROL PANEL (OPERATION PANEL)
10: JUNCTION BOX (CONTROL PANEL CASING)
11: ASSEMBLING TERMINAL
12: FEMALE TERMINAL
13: GENERATOR CIRCUIT (CIRCUIT OF OPERATING MACHINE)
20: SWITCH PORTION (ELECTRIC PART)
21: VOLTAGE SWITCHING SWITCH
22: MALE TERMINAL
30: RELAY CONNECTOR
31: DEFINING WALL
32: FITTING PORTION
33: RELAY TERMINAL
34: GUIDE BODY
35: HOLE
36: CENTRAL HOLE
37: PROTRUSION
38: NOTCH
40: WATERPROOF SHEET
41: HOLE
42: CONVEX PORTION
43: CIRCULAR HOLE (HOLE)

The invention claimed is:

1. An electric part connection mechanism which is disposed in an operating machine and connects an electric part (20) mounted on an operation panel (5) of an operating machine (1) to an assembling terminal of a junction box (10) having a plurality of terminals connected to a circuit (13) of the operating machine via a relay connector (30) of a cylindrical body, wherein the relay connector (30) includes:

a defining wall (31) which is formed inside the cylindrical body;

a fitting portion (32) which is formed at one side of the defining wall so as to fit the electric part (20);

a plurality of relay terminals (33) which is attached to the other side of the defining wall (31) and is connectable to the plurality of terminals; and a plurality of holes which is provided in the defining wall (31) so as face front ends of the plurality of relay terminals, respectively.

2. The electric part connection mechanism according to claim 1, comprising:

a waterproof sheet (40) which is attached to the fitting portion (32) side of the defining wall (31), and has a plurality of holes (41) corresponding to the plurality of holes (35); and an opening or a notch which is provided at the lower portion, in the direction of gravity, of an outer wall of the cylindrical body so as to allow the fitting portion (32) to communicate with the outside thereof.

3. The electric part connection mechanism according to claim 2, wherein the opening or the notch (38) provided in the outer wall of the relay connector (30) is disposed closer to the operation panel (5) than the waterproof sheet (40).

4. The electric part connection mechanism according to claim 2, wherein the waterproof sheet (40) includes holes (43) which allow protrusions (37), provided at asymmetric positions in the defining wall (31), to be inserted thereinto (40).

5. The electric part connection mechanism according to claim 3, wherein the waterproof sheet (40) includes holes (43) which allow protrusions (37), provided at asymmetric positions in the defining wall (31), to be inserted thereinto.

* * * * *